US009881561B2

(12) United States Patent
Lee et al.

(10) Patent No.: US 9,881,561 B2
(45) Date of Patent: Jan. 30, 2018

(54) ELECTRONIC DEVICE AND METHOD OF CONTROLLING OUTPUT CHARACTERISTIC THEREOF

(71) Applicant: Samsung Electronics Co., Ltd., Suwon-si, Gyeonggi-do (KR)

(72) Inventors: Seungjae Lee, Suwon-si (KR); Jaewan Kim, Suwon-si (KR); Jeonghun Kim, Suwon-si (KR); Dongsub Kim, Suwon-si (KR); Hyunchang Shin, Seongnam-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 41 days.

(21) Appl. No.: 14/720,030

(22) Filed: May 22, 2015

(65) Prior Publication Data

US 2015/0339986 A1 Nov. 26, 2015

(30) Foreign Application Priority Data

May 23, 2014 (KR) ..... 10-2014-0062598

(51) Int. Cl.
*G09G 3/34* (2006.01)
*G09G 3/20* (2006.01)

(52) U.S. Cl.
CPC ..... *G09G 3/3406* (2013.01); *G09G 3/20* (2013.01); *G09G 2320/0233* (2013.01); *G09G 2320/0276* (2013.01); *G09G 2320/0613* (2013.01); *G09G 2320/0646* (2013.01); *G09G 2320/0673* (2013.01); *G09G 2320/0686* (2013.01); *G09G 2360/144* (2013.01)

(58) Field of Classification Search
CPC ..... G09G 2360/144; G09G 2320/0276; G09G 2310/027; G09G 2320/0673; H04N 1/6027; H04N 1/407; H04N 5/202; H04N 2201/0089; G06F 2201/81
See application file for complete search history.

(56) References Cited

U.S. PATENT DOCUMENTS

2004/0233153 A1 11/2004 Robinson
2005/0116911 A1 6/2005 Mukai
2005/0264702 A1 12/2005 Yoshii
2006/0082566 A1* 4/2006 Akimoto ..... G09G 3/2007 345/204
2006/0284895 A1* 12/2006 Marcu ..... G09G 3/20 345/690
2007/0176870 A1* 8/2007 Hung ..... G09G 3/3413 345/88
2008/0165115 A1 7/2008 Herz et al.
(Continued)

FOREIGN PATENT DOCUMENTS

JP 2013-238806 A 11/2013
KR 10-2005-0116224 A 12/2005
KR 10-2011-0133210 A 12/2011

*Primary Examiner* — Gerald Johnson
(74) *Attorney, Agent, or Firm* — Jefferson IP Law, LLP

(57) ABSTRACT

A method of controlling an output characteristic of an electronic device is provided. The method includes executing an application, detecting the brightness of an ambient environment, determining a gamma characteristic based on the executing application and the detected brightness, and outputting a screen of the running application based on the determined gamma characteristic.

20 Claims, 6 Drawing Sheets

(56) References Cited

U.S. PATENT DOCUMENTS

| | | | | |
|---|---|---|---|---|
| 2008/0204438 | A1* | 8/2008 | Song | G09G 3/3225 345/207 |
| 2008/0297626 | A1* | 12/2008 | Hashimoto | F16M 11/2092 348/240.99 |
| 2009/0009525 | A1 | 1/2009 | Hirashima et al. | |
| 2010/0277452 | A1* | 11/2010 | Muraki | H04N 5/202 345/207 |
| 2011/0298764 | A1 | 12/2011 | Ha | |
| 2012/0056862 | A1 | 3/2012 | Yamazaki et al. | |
| 2012/0206638 | A1* | 8/2012 | Saitoh | G09G 3/3611 348/333.05 |
| 2012/0268474 | A1 | 10/2012 | Hachiya | |

* cited by examiner

<213>

<215>

<223>

<225>

ELECTRONIC DEVICE AND METHOD OF CONTROLLING OUTPUT CHARACTERISTIC THEREOF

CROSS-REFERENCE TO RELATED APPLICATION(S)

This application claims the benefit under 35 U.S.C. § 119(a) of a Korean patent application filed on May 23, 2014 in the Korean Intellectual Property Office and assigned Serial No. 10-2014-0062598, the entire disclosure of which is hereby incorporated by reference.

TECHNICAL FIELD

The present disclosure relates to an electronic device including a display and a method of determining an output characteristic thereof.

BACKGROUND

With the advent of small electronic devices, such as ultra books, as well as portable terminals such as smart phones, tablet personal computers (PCs), and the like, portability of electronic devices has significantly increased. As such, users can execute various applications using the portable electronic devices not only indoors but also outdoors.

Screen display technology for the electronic devices is also evolving. In order to support the portability of an electronic device, it is an important issue to improve the visibility and legibility of a screen not only indoors but also outdoors.

The above information is presented as background information only to assist with an understanding of the present disclosure. No determination has been made, and no assertion is made, as to whether any of the above might be applicable as prior art with regard to the present disclosure.

SUMMARY

In general, electronic devices have a screen configured to provide optimum visibility and legibility to users in an indoor environment. Accordingly, a characteristic of the output screen may have been configured based on the average indoor brightness.

With increasing portability of electronic devices, a user may also use the electronic device in an outdoor environment, which is different from an indoor environment. Accordingly, it is difficult to provide an optimum screen for the user through a previously set output screen characteristic in a different environment from an indoor environment, for example, in an environment in which the brightness of an ambient environment is considerably different.

Aspects of the present disclosure are to address at least the above-mentioned problems and/or disadvantages and to provide at least the advantages described below. Accordingly, an aspect of the present disclosure is to provide an electronic device including a display and a method of determining an output characteristic thereof.

In accordance with an aspect of the present disclosure, a method of controlling an output characteristic of an electronic device is provided. The method includes executing an application, detecting a brightness of an ambient environment, determining a gamma characteristic based on the executing application and the detected brightness, and outputting a screen of the executing application based on the determined gamma characteristic.

In accordance with another aspect of the present disclosure, a method of controlling an output characteristic of an electronic device is provided. The method includes detecting a brightness of an ambient environment, analyzing a percentage of at least one of text and an image of a screen, determining a gamma characteristic based on the detected brightness and the percentage analysis result, and outputting the screen based on the determined gamma characteristic.

In accordance with another aspect of the present disclosure, an electronic device is provided. The electronic device includes a sensor unit configured to detect a brightness of an ambient environment, a controller configured to execute an application, determine a gamma characteristic based on the executing application and the brightness detected by the sensor unit, and configure a screen of the executing application based on the determined gamma characteristic, and a display configured to output the screen.

In accordance with another aspect of the present disclosure, an electronic device is provided. The electronic device includes a sensor unit configured to detect a brightness of an ambient environment, a controller configured to analyze a percentage of at least one of text and an image of a screen, determine a gamma characteristic based on the brightness detected by the sensor unit and the percentage analysis result, and configure the screen based on the determined gamma characteristic, and a display configured to output the screen.

According to various embodiments of the present disclosure, an electronic device can improve visibility and legibility of a screen that is output adaptively to the brightness of an ambient environment.

In addition, according to various embodiments of the present disclosure, an electronic device can provide a screen that is improved adaptively to a type of content output through a display in an outdoor environment.

Furthermore, according to various embodiments of the present disclosure, an electronic device can improve visibility of an image and legibility of text, the image and the text being output in an outdoor environment.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, it should be noted that like reference numbers are used to depict the same or similar elements, features, and structures.

DETAILED DESCRIPTION

Figure 1:
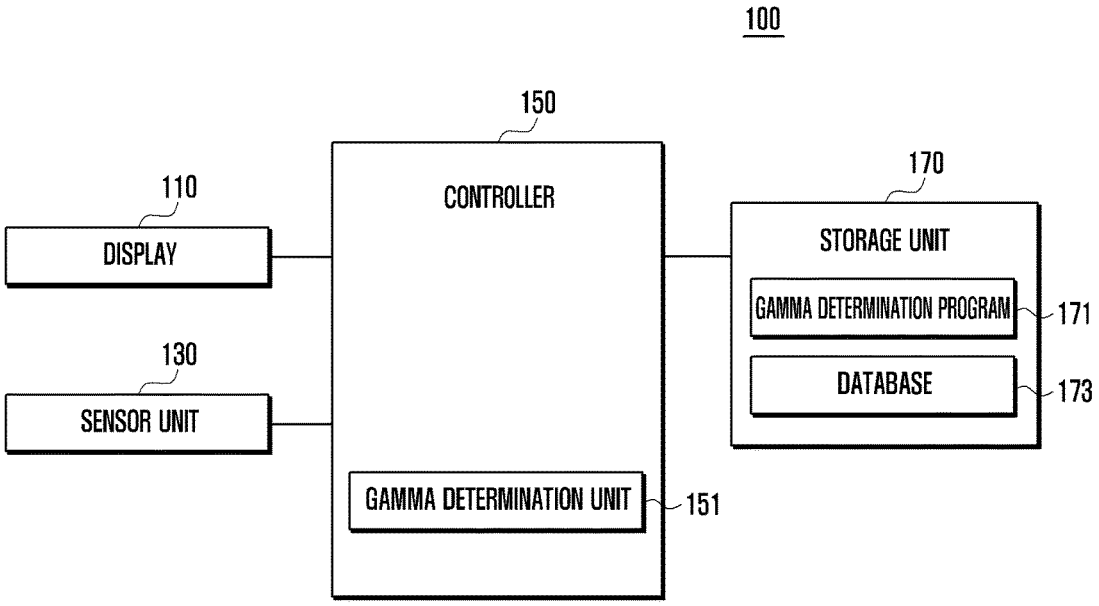
FIG. 1 is a block diagram of an electronic device according to an embodiment of the present disclosure.

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

As used in various embodiments of the present disclosure, the expressions "include", "may include" and other conjugates refer to the existence of a corresponding disclosed function, operation, or constituent element, and do not limit one or more additional functions, operations, or constituent elements. Further, as used in various embodiments of the present disclosure, the terms "include", "have", and their conjugates are intended merely to denote a certain feature, numeral, step, operation, element, component, or a combination thereof, and should not be construed to initially exclude the existence of or a possibility of addition of one or more other features, numerals, steps, operations, elements, components, or combinations thereof.

Further, as used in various embodiments of the present disclosure, the expression "or" includes any or all combinations of words enumerated together. For example, the expression "A or B" may include A, may include B, or may include both A and B.

While expressions including ordinal numbers, such as "first" and "second", as used in various embodiments of the present disclosure may modify various constituent elements, such constituent elements are not limited by the above expressions. For example, the above expressions do not limit the sequence and/or importance of the elements. The expressions may be used to distinguish a component element from another component element. For example, a first user device and a second user device indicate different user devices although both of them are user devices. For example, a first constituent element may be termed a second constituent element, and likewise a second constituent element may also be termed a first constituent element without departing from the scope of various embodiments of the present disclosure.

It should be noted that if it is described that one component element is "coupled" or "connected" to another component element, the first component element may be directly coupled or connected to the second component, and a third component element may be "coupled" or "connected" between the first and second component elements. Conversely, when one component element is "directly coupled" or "directly connected" to another component element, it may be construed that a third component element does not exist between the first component element and the second component element.

The terms as used in various embodiments of the present disclosure are merely for the purpose of describing particular embodiments and are not intended to limit the various embodiments of the present disclosure.

Unless defined otherwise, all terms used herein, including technical terms and scientific terms, have the same meaning as commonly understood by a person of ordinary skill in the art to which various embodiments of the present disclosure pertain. Such terms as those defined in a generally used dictionary are to be interpreted to have the meanings equal to the contextual meanings in the relevant field of art, and are not to be interpreted to have ideal or excessively formal meanings unless clearly defined in various embodiments of the present disclosure.

An electronic device according to various embodiments of the present disclosure may be a device including a display. For example, the electronic device may include at least one of a smart phone, a tablet personal computer (PC), a mobile phone, a video phone, an e-book reader, a desktop PC, a laptop PC, a netbook computer, a personal digital assistant (PDA), a portable multimedia player (PMP), an MP3 player, a mobile medical device, a camera, a wearable device (e.g., a head-mounted-device (HMD) such as electronic glasses, electronic clothes, an electronic bracelet, an electronic necklace, an electronic appcessory, an electronic tattoo, or a smart watch).

Hereinafter, an electronic device according to various embodiments will be described with reference to the accompanying drawings. In various embodiments, the term "user" may indicate a person using an electronic device or a device (e.g. an artificial intelligence electronic device) using an electronic device.

FIG. 1 is a block diagram of an electronic device according to an embodiment of the present disclosure.

Referring to FIG. 1, the electronic device 100 may include a display 110, a sensor unit 130, a controller 150, and a storage unit 170.

The display 110 may output a screen that the controller 150 provides. The display 110 may include a panel. The panel may be, for example, a Liquid Crystal Display (LCD), an Active Matrix Organic Light Emitting Diode (AMOLED), or the like. The panel may be embodied to be, for example, flexible, transparent, or wearable. The panel may be formed as a single module with a touch panel. According to an embodiment, the display 110 may further include a control circuit (not shown) for controlling the panel.

The sensor 130 may measure or detect a physical quantity of an ambient environment and convert the measured or detected information into an electric signal. According to an embodiment, the sensor 130 may detect the brightness of the ambient environment and provide the detected information to the controller 150. In one example, the sensor unit 130 may include an illumination sensor. The illumination sensor may sense an intensity of illumination of the ambient environment and provide the sensed value to the controller 150.

The controller 150 may control a plurality of hardware or software elements connected to the electronic device by executing an operating system or an application program (e.g., an application) and perform data processing and calculations for various types of data including multimedia data. The controller 150 according to an embodiment of the present disclosure may determine a gamma characteristic of a screen output to the display 110. The term "gamma characteristic" means a characteristic related to the brightness of the output screen. It is possible to improve the visibility of the screen by adjusting the gamma characteristic.

According to an embodiment of the present disclosure, the controller 150 may include a gamma determination unit 151 for determining the gamma characteristic of the output screen. According to an embodiment of the present disclosure, the gamma determination unit 151 may determine the gamma characteristic based on the brightness information of the ambient environment provided by the sensor unit 130 and information on a running application.

An operation of the gamma determination unit 151 will be described with reference to FIGS. 2A and 2B. Although 256 grayscale levels are illustrated as an example in FIGS. 2A and 2B, it is well-known to those skilled in the art that the present disclosure is not limited thereto.

Figure 2A:
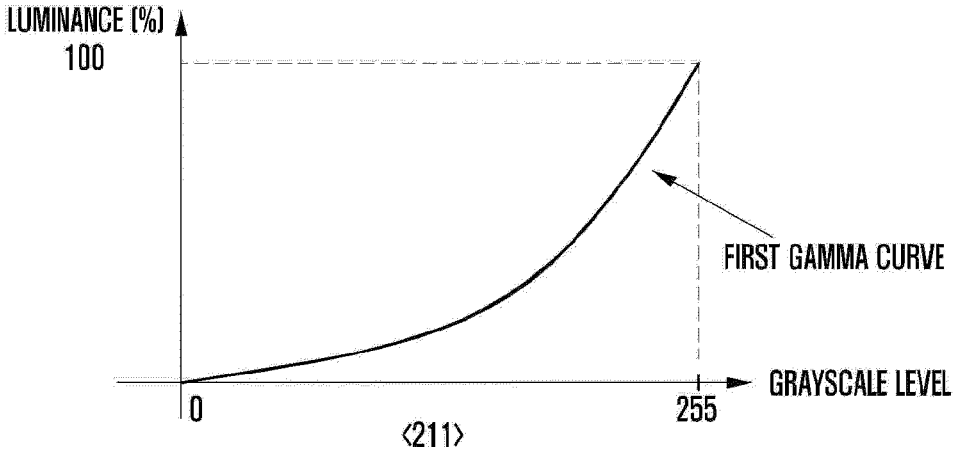
FIG. 2A illustrates an example of an output corresponding to a first gamma characteristic according to an embodiment of the present disclosure.
Figure 2A:
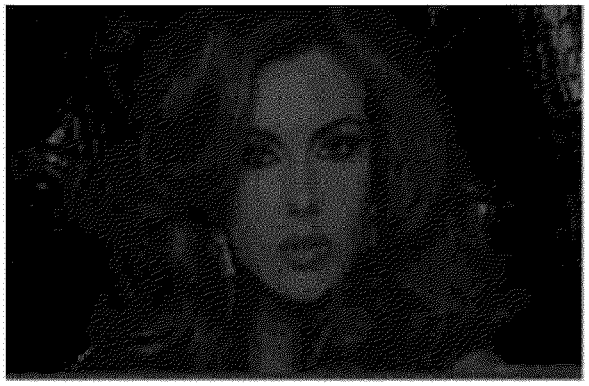
Figure 2A:
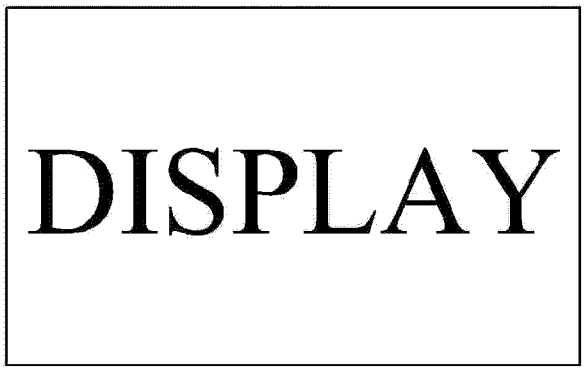

FIG. 2A illustrates an example of an output corresponding to a first gamma characteristic according to an embodiment of the present disclosure.

Referring to FIG. 2A, the gamma determination unit 151 may set a gamma characteristic like a first gamma curve illustrated in screen <211> as an initial value. For example, the first gamma curve may be set in view of indoor visibility since users generally use electronic devices, such as smart phones, indoors. When the gamma characteristic of the first gamma curve is maintained in an outdoor environment in which the brightness of an ambient environment rapidly increases, visibility of a screen is degraded since the brightness of an output image is lower than that of the ambient environment as illustrated in screen <213>.

Figure 2B:
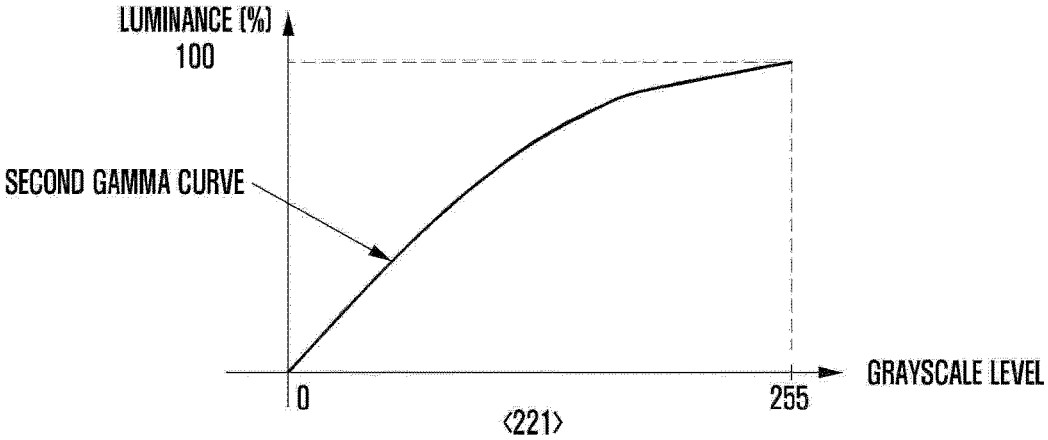
FIG. 2B illustrates an example of an output corresponding to a second gamma characteristic according to an embodiment of the present disclosure.
Figure 2B:
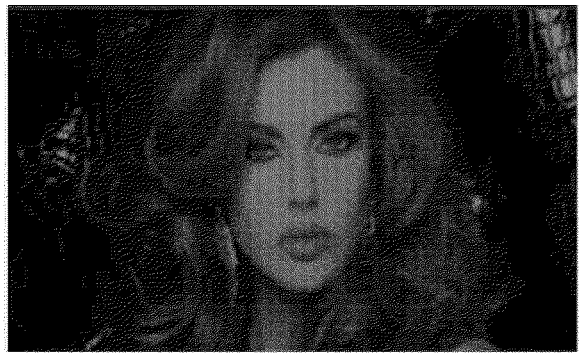
Figure 2B:
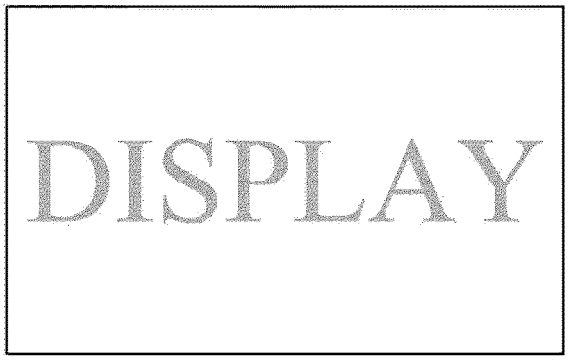

FIG. 2B illustrates an example of an output corresponding to a second gamma characteristic according to an embodiment of the present disclosure.

Referring to FIG. 2B, when it is determined that the brightness of the ambient environment is higher than or equal to a reference value, the gamma determination unit 151 may change the gamma characteristic as in a second gamma curve illustrated in screen <221>. That is, when the brightness of the ambient environment is higher than or equal to the reference value, the gamma determination unit 151 may improve the gamma characteristic in such a manner of increasing luminance at a low grayscale level. According to the gamma characteristic of the second gamma curve, the brightness of the image increases as illustrated in screen <223> and therefore, the visibility of the screen can be improved in the outdoor environment in which the brightness of the ambient environment is high.

Meanwhile, when text, rather than an image, is output to the display 110, a different problem may arise. For example, according to the gamma characteristic of the first gamma curve, the brightness of the text is relatively high as illustrated in screen <215> and therefore, legibility of the text may be good in the outdoor environment in which the brightness of the ambient environment is high. In contrast, according to the gamma characteristic of the second gamma curve, the brightness of the text is relatively low as illustrated in screen <225> and therefore, the legibility of the text may be deteriorated in the outdoor environment in which the brightness of the ambient environment is high. That is, when the electronic device 100 is situated in the outdoor environment in which the brightness of the ambient environment is high, an optimized gamma characteristic may vary depending on whether content output via the display 110 is based on an image or text.

Accordingly, when the brightness of the ambient environment is higher than or equal to the reference value, the gamma determination unit 151, according to an embodiment of the present disclosure, may select different gamma characteristics depending on whether content included in an output screen is based on an image or text. For example, the gamma determination unit 151 may select a gamma characteristic like the first gamma curve when content included in an output screen is based on text, and may select a gamma characteristic like the second gamma curve when content included in an output screen is based on an image. It should be understood that this is only an exemplary embodiment and the gamma characteristic is not limited thereto.

Using various methods, the gamma determination 151 may determine whether content included in an output screen is based on an image or text. According to an embodiment, when a screen of a running application is output through the display 110, the gamma determination unit 151 may make the determination according to the running application. For example, in cases where the running application is a text based application, for example an Internet application or an e-book application, the gamma determination unit 151 may select the first gamma characteristic in a situation in which the brightness of the ambient environment is higher than or equal to a reference value. In contrast, in cases where the running application is a photo or video based application, for example a photo gallery application or a video player application, the gamma determination unit 151 may select the second gamma characteristic in a situation in which the brightness of the ambient environment is higher than or equal to a reference value.

According to an embodiment of the present disclosure, the gamma determination unit 151 may analyze a percentage of at least one of text and an image on an output screen. The determination on the percentage of the text or image on the output screen may be made in such a manner of determining a ratio of pixels outputting the text or image to total pixels. According to an embodiment of the present disclosure, when the percentage of the text is higher than or equal to a reference value in a situation in which the brightness of the ambient environment is higher than or equal to a reference value, the gamma determination unit 151 may select the first gamma characteristic. According to an embodiment, when the percentage of the image is higher than or equal to a reference value in a situation in which the brightness of the ambient environment is higher than or equal to a reference value, the gamma determination unit 151 may select the second gamma characteristic. According to an embodiment, the gamma determination unit 151 may also select the gamma characteristic in comprehensive consideration of the percentages of the text and the image.

According to an embodiment of the present disclosure, an optimum gamma characteristic corresponding to the brightness of the ambient environment and the percentage of the text or the image may have been stored as a mapping table in a database 173 of the storage unit 170. Accordingly, the gamma determination unit 151 may determine an optimum gamma characteristic in each situation based on the mapping table stored in the database 173.

The storage unit 170 may store various programming modules that can be executed in the controller 150 and various types of data including data generated in the controller 150. According to an embodiment of the present disclosure, the storage unit 170 may have a gamma determination program 171 recorded therein which is executed in the gamma determination unit 151. In addition, the storage unit 170 may have the optimum gamma characteristic recorded as the mapping table in the database 173, the optimum gamma characteristic corresponding to the brightness of the ambient environment and the percentage of the text or image. The gamma determination unit 151 may execute the gamma determination program 171 and refer to the mapping table of the database 173 to determine the gamma characteristic.

Figure 3:
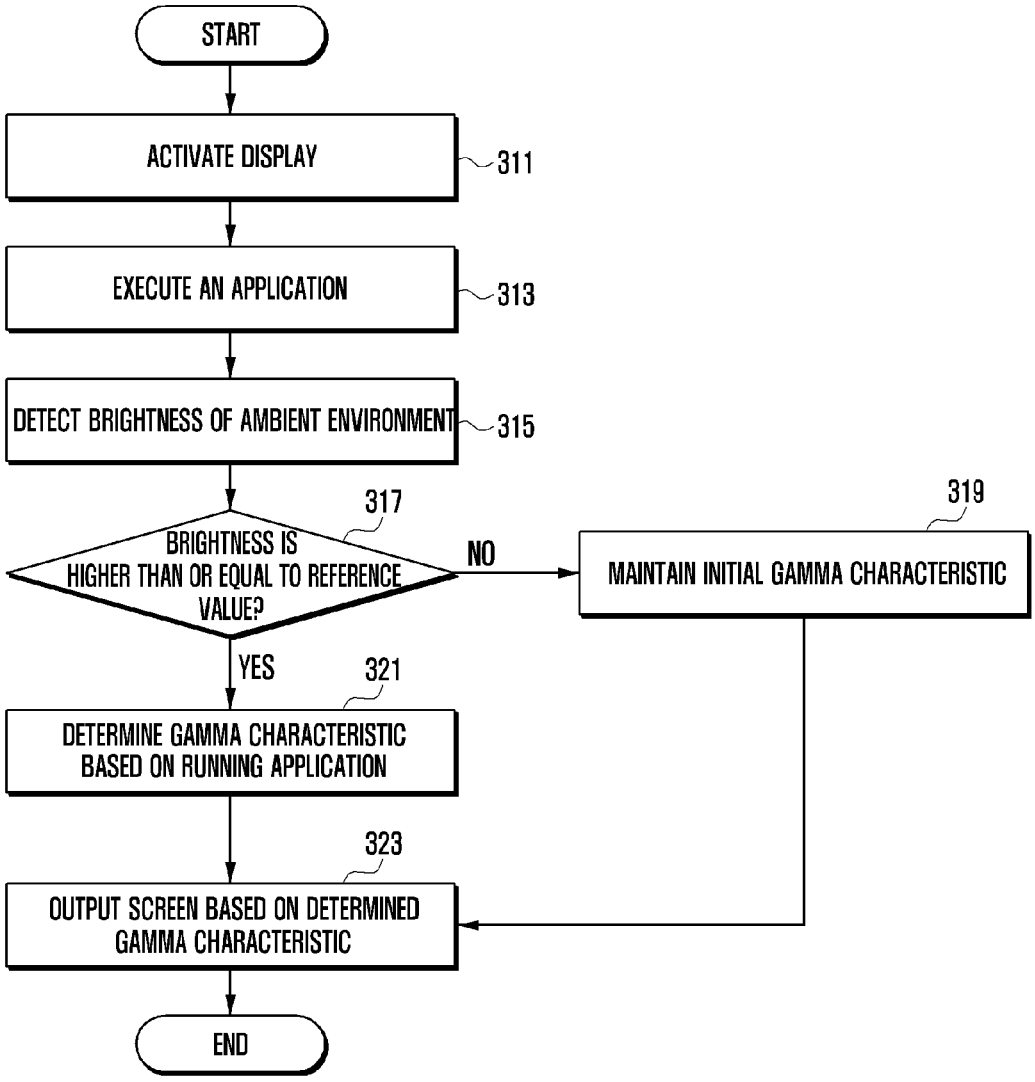
FIG. 3 is a flowchart illustrating a method of controlling an output characteristic of an electronic device according to an embodiment of the present disclosure.

FIG. 3 is a flowchart illustrating a method of controlling an output characteristic of an electronic device according to an embodiment of the present disclosure.

Referring to FIG. 3, the electronic device 100 may activate the display 110 in operation 311 and execute an application in operation 313. Operations 311 and 313 may be performed irrespective of the sequence thereof and may be performed by a user's manipulation. An initial gamma characteristic may have been set for the electronic device 100. The initial gamma characteristic may have been set in view of, for example, visibility in an indoor environment.

In operation 315, the electronic device 100 may detect the brightness of an ambient environment through the sensor unit 130. For example, the electronic device 100 may sense the intensity of illumination using an illumination sensor. In operation 317, the electronic device 100 may compare the sensed brightness with a reference value to determine whether the sensed brightness is higher than or equal to the reference value. When the sensed brightness is lower than the reference value, the electronic device 100 may maintain the initially set gamma characteristic in operation 319.

In contrast, when the sensed brightness is higher than or equal to the reference value, the electronic device 100 may determine a gamma characteristic based on the running application in operation 321. For example, in cases where the running application is a text base application, for example an Internet application or an e-book application, the electronic device 100 may select a first gamma characteristic. In contrast, in cases where the running application is a photo or video based application, for example a photo gallery application or a video player application, the electronic device 100 may select a second gamma characteristic further improved than the first gamma characteristic. In this case, a meaning that the gamma characteristic is improved may include a meaning that luminance is improved at a low grayscale level as mentioned above.

After determining the gamma characteristic in operations 319 and 321, the electronic device 100 may configure a screen of the running application based on the determined gamma characteristic and output the configured screen through the display 110 in operation 323.

Figure 4:
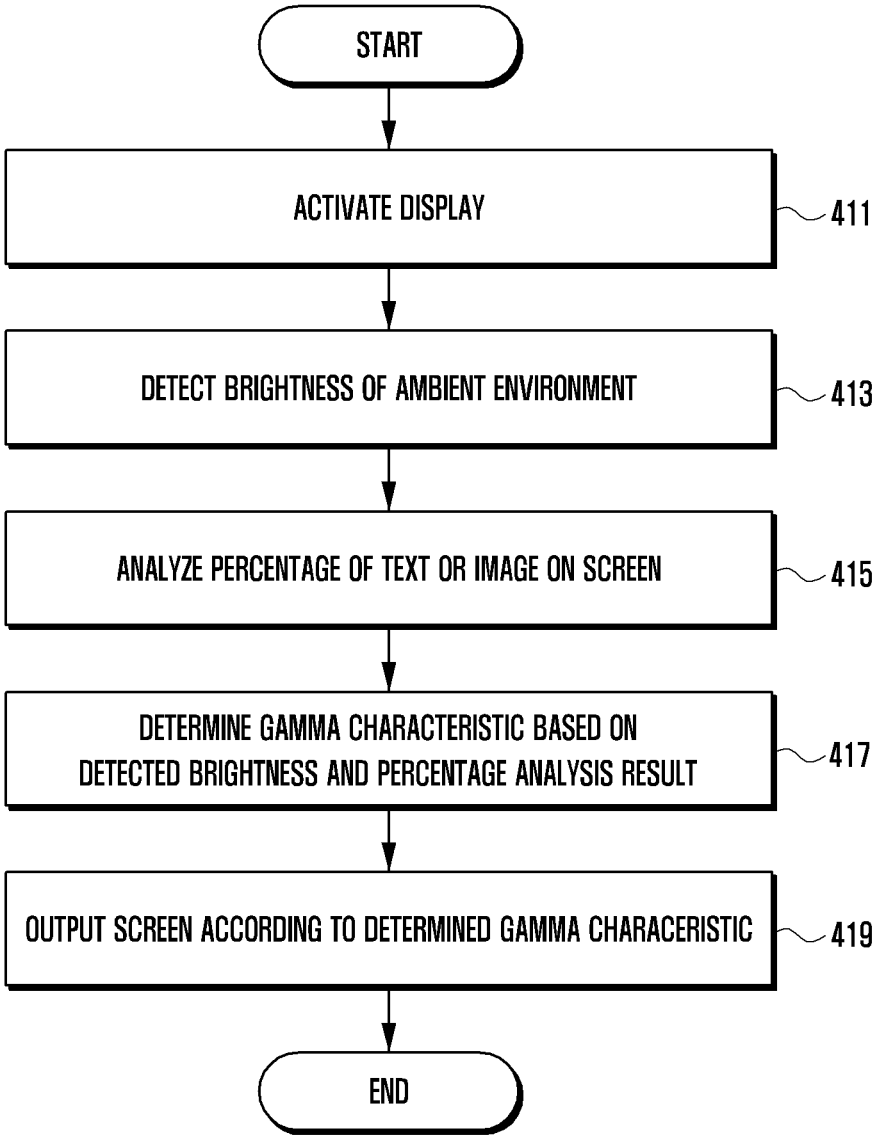
FIG. 4 is a flowchart illustrating a method of controlling an output characteristic of an electronic device according to an embodiment of the present disclosure.

FIG. 4 is a flowchart illustrating a method of controlling an output characteristic of an electronic device according to another embodiment of the present disclosure.

Referring to FIG. 4, the electronic device 100 may activate the display 110 in operation 411. An initial gamma characteristic may have been set for the electronic device 100. The initial gamma characteristic may have been set in view of, for example, visibility in an indoor environment.

In operation 413, the electronic device 100 may detect the brightness of an ambient environment through the sensor unit 130. For example, the electronic device 100 may sense an intensity of illumination using an illumination sensor. In operation 415, the electronic device 100 may analyze a percentage of at least one of text and an image on an output screen. The determination on the percentage of the text or image on the output screen may be made in such a manner of determining a ratio of pixels outputting the text or image to total pixels.

In operation 417, the electronic device 100 may determine a gamma characteristic based on the detected brightness of the ambient environment and the percentage analysis result. According to an embodiment, when the percentage of the text is higher than or equal to a reference value in a situation in which the brightness of the ambient environment is higher than or equal to a reference value, the electronic device 100 may select a first gamma characteristic. In addition, according to an embodiment, when the percentage of the image is higher than or equal to a reference value in a situation in which the brightness of the ambient environment is higher than or equal to a reference value, the electronic device 100 may select a second gamma characteristic further improved than the first gamma characteristic. According to an embodiment, the electronic device 100 may select the gamma characteristic in comprehensive consideration of the percentages of the text and the image.

According to an embodiment of the present disclosure, an optimum gamma characteristic corresponding to the brightness of the ambient environment and the percentage of the text or the image may have been stored as a mapping table in the database 173 of the storage unit 170. Accordingly, the electronic device 100 may select an optimum gamma characteristic corresponding to the detected brightness of the ambient environment and the percentage analysis result based on the mapping table stored in the database 173.

After determining the gamma characteristic, the electronic device 100 may configure a screen of a running application based on the determined gamma characteristic and output the configured screen through the display 110 in operation 419.

Figure 5:
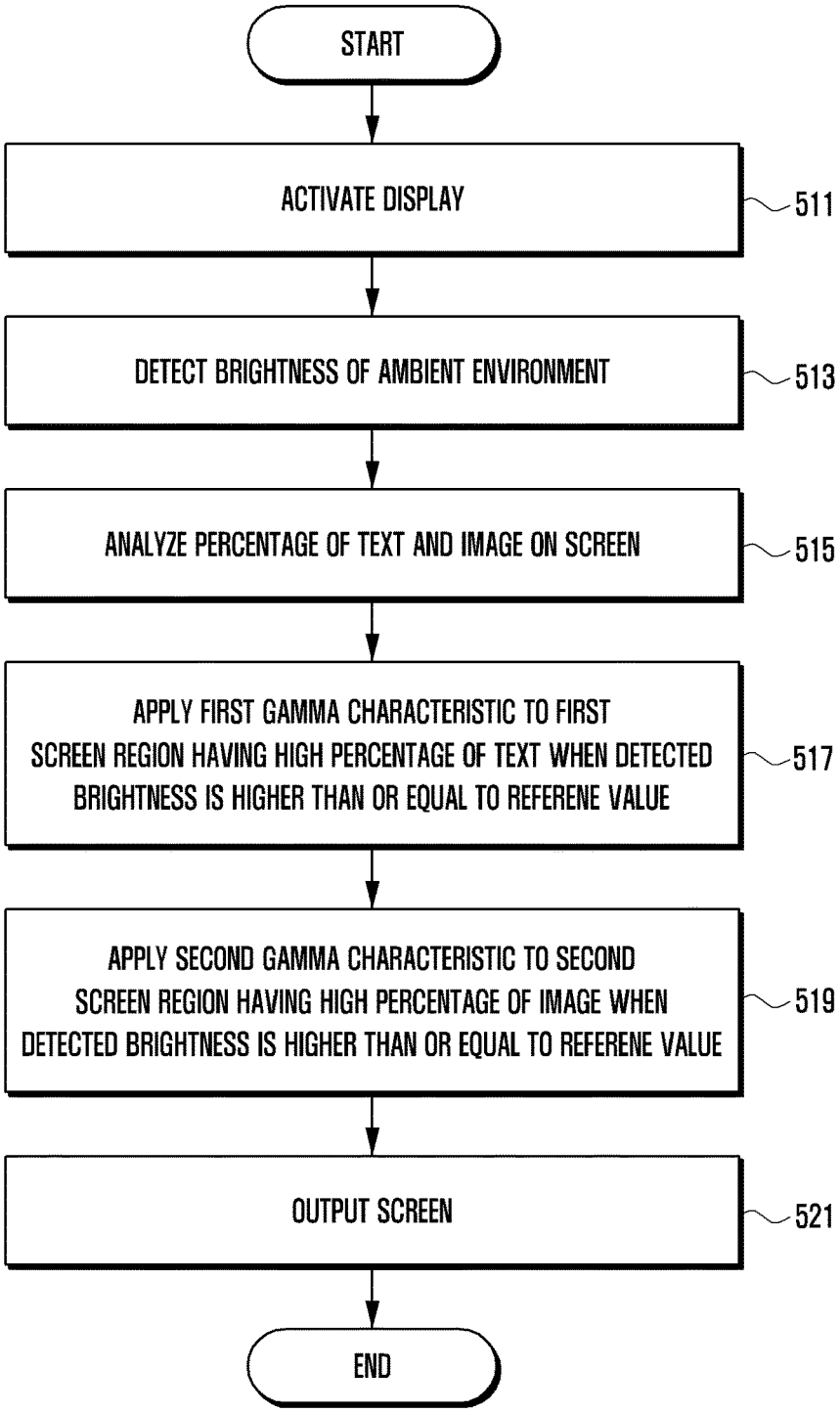
FIG. 5 is a flowchart illustrating a method of controlling an output characteristic of an electronic device according to another embodiment of the present disclosure.

FIG. 5 is a flowchart illustrating a method of controlling an output characteristic of an electronic device according to another embodiment of the present disclosure.

Referring to FIG. 5, the electronic device 100 may activate the display 110 in operation 511. An initial gamma characteristic may have been set for the electronic device 100. The initial gamma characteristic may have been set in view of, for example, visibility in an indoor environment.

In operation 513, the electronic device 100 may detect the brightness of an ambient environment through the sensor unit 130. For example, the electronic device 100 may sense an intensity of illumination using an illumination sensor. In operation 515, the electronic device 100 may analyze a percentage of at least one of text and an image on an output screen. The determination on the percentage of the text or image on the output screen may be made in such a manner of determining a ratio of pixels outputting the text or image to total pixels.

The electronic device 100 may divide the screen to set a gamma characteristic according to the type of content included in the output screen. For example, the electronic device 100 may distinguish the output screen into a first screen region where a percentage of text is higher than that of an image and a second screen region where a percentage of an image is higher than that of text. According to an embodiment, when the detected brightness of the ambient environment is higher than or equal to a reference value, the electronic device 100 may, in operation 517, apply a first gamma characteristic to the first screen region where the percentage of the text is higher than that of the image. When the detected brightness of the ambient environment is higher than or equal to the reference value, the electronic device 100 may, in operation 519, apply a second gamma characteristic to the second screen region where the percentage of the image is higher than that of the text. Therefore, according to an embodiment, one screen output through the display 110 may be distinguished into the first and second screen regions according to the different gamma characteristics that are applied. In operation 521, the electronic device 100 may output the screen through the display 110 based on the applied gamma characteristics.

Thus, the electronic device 100 according to the various embodiments of the present disclosure can effectively improve visibility and legibility in a relatively light environment such as an outdoor environment.

The aforementioned elements of the electronic device according to various embodiments of the present disclosure may be constituted by one or more components, and the name of the corresponding element may vary with a type of electronic device. The electronic device according to various embodiments of the present disclosure may include at least one of the aforementioned elements. Some elements may be omitted or other additional elements may be further included in the electronic device. Further, some of the components of the electronic device according to the various embodiments of the present disclosure may be combined to form a single entity, and thus, may equivalently execute functions of the corresponding elements prior to the combination.

According to various embodiments of the present disclosure, at least a part of the device or method according to the various embodiments of the present disclosure may be implemented by, for example, an instruction stored in a computer-readable storage medium in the form of a programming module. When the command is executed by one or more processors (for example, the processor 150), the one or more processors may execute a function corresponding to the command. The computer-readable storage medium may be, for example, the memory 170. At least some of the programming modules may be implemented (for example, executed) by, for example, the processor 150.

The computer readable recording medium may include magnetic media such as a hard disc, a floppy disc, and a magnetic tape, optical media such as a compact disc read only memory (CD-ROM) and a digital versatile disc (DVD), magneto-optical media such as a floptical disk, and hardware devices specifically configured to store and execute program commands, such as a ROM, a random access memory (RAM), and a flash memory. In addition, the program instructions may include high class language codes, which can be executed in a computer by using an interpreter, as well as machine codes made by a compiler. The aforementioned hardware device may be configured to operate as one or more software modules in order to perform the operation of various embodiments of the present disclosure, and vice versa.

Various embodiments of the present disclosure may include at least one of the aforementioned elements, may exclude some of them, or may further include other additional elements. Operations according to various embodiments of the present disclosure may be performed sequentially, in parallel, repeatedly, or in a heuristic manner. Further, some operations may be executed according to another order or may be omitted, or other operations may be added.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. A method of controlling an output characteristic of an electronic device, the method comprising:

executing an application;

detecting a brightness of an ambient environment;

determining a gamma characteristic of a display based on the executing application when the detected brightness is higher than or equal to a reference value; and outputting a screen of the executing application based on the determined gamma characteristic, wherein the determining of the gamma characteristic comprises selecting a first gamma characteristic when the executing application is a text based application and selecting a second gamma characteristic when the executing application is a photo or video based application.

2. The method of claim 1, wherein the detecting of the brightness comprises:

sensing an intensity of illumination of the ambient environment.

3. The method of claim 1, wherein the determining of the gamma characteristic comprises:

maintaining a first gamma characteristic, that is initially set, when the detected brightness is lower than the reference value; and selecting the first gamma characteristic or a second gamma characteristic further improved than the first gamma characteristic based on the executing application when the detected brightness is equal to or higher than the reference value.

4. The method of claim 1, wherein the text based application includes a web browser application, an e-mail application or an e-book application, and the photo or video based application includes a photo gallery application, game application or a video player application.

5. A method of controlling an output characteristic of an electronic device, the method comprising:

detecting a brightness of an ambient environment;

analyzing a percentage of at least one of text and an image of a screen;

determining a gamma characteristic based on the detected brightness and the percentage analysis result; and outputting the screen based on the determined gamma characteristic.

6. The method of claim 5, wherein the determining of the gamma characteristic comprises:

selecting a first gamma characteristic when the detected brightness is higher than a first reference value and the percentage of the text is higher than a second reference value.

7. The method of claim 6, wherein the determining of the gamma characteristic further comprises:

selecting a second gamma characteristic further improved than the first gamma characteristic when the detected brightness is higher than the first reference value and the percentage of the image is higher than a third reference value.

8. The method of claim 5, wherein the determining of the gamma characteristic comprises:

determining the gamma characteristic using a mapping table in which a gamma characteristic corresponding to the detected brightness and the percentage of the text or the image is stored.

9. The method of claim 5, wherein the analyzing of the percentage of the text or the image comprises:

distinguishing the screen into a first screen region where the percentage of the text is higher than that of the image and a second screen region where the percentage of the image is higher than that of the text.

10. The method of claim 9, wherein the determining of the gamma characteristic comprises:

applying a first gamma characteristic to the first screen region and a second gamma characteristic further improved than the first gamma characteristic to the second screen region when the detected brightness is higher than a first reference value.

11. An electronic device comprising:

a sensor unit configured to detect a brightness of an ambient environment;

a display configured to output a screen; and a controller configured to:

execute an application, determine a gamma characteristic of the display based on the executing application when the brightness detected by the sensor unit is higher than or equal to a reference value, and configure a screen of the executing application based on the determined gamma characteristic, wherein the controller is further configured to determine the gamma characteristic by selecting a first gamma characteristic when the executing application is a text based application and select a second gamma characteristic when the executing application is a photo or video based application.

12. The electronic device of claim 11, wherein the sensor unit comprises an illumination sensor configured to sense an intensity of illumination of the ambient environment.

13. The electronic device of claim 11, wherein the controller is further configured to maintain a first gamma characteristic that is initially set, when the brightness is lower than the reference value, and to select the first gamma characteristic or a second gamma characteristic further improved than the first gamma characteristic based on the executing application when the detected brightness is equal to or higher than the reference value.

14. The electronic device of claim 11, wherein the text based application includes a web browser application, an e-mail application or an e-book application, and the photo or video based application includes a photo gallery application, game application or a video player application.

15. An electronic device comprising:

a sensor unit configured to detect a brightness of an ambient environment;

a controller configured to:

analyze a percentage of at least one of text and an image of a screen, determine a gamma characteristic based on the brightness detected by the sensor unit and the percentage analysis result, and configure the screen based on the determined gamma characteristic; and a display configured to output the screen.

16. The electronic device of claim 15, wherein the controller is further configured to select a first gamma characteristic when the brightness is higher than a first reference value and the percentage of the text is higher than a second reference value.

17. The electronic device of claim 16, wherein the controller is further configured to select a second gamma characteristic further improved than the first gamma characteristic when the brightness is higher than the first reference value and the percentage of the image is higher than a third reference value.

18. The electronic device of claim 15, further comprising:

a storage unit comprising a mapping table configured to store a gamma characteristic corresponding to the brightness and the percentage of the text or the image.

19. The electronic device of claim 15, wherein the controller is further configured to distinguish the screen into a first screen region where the percentage of the text is higher than that of the image and a second screen region where the percentage of the image is higher than that of the text.

20. The electronic device of claim 19, wherein the controller is further configured to apply a first gamma characteristic to the first screen region and a second gamma characteristic further improved than the first gamma characteristic to the second screen region when the detected brightness is higher than a first reference value.

* * * * *